US009056465B2

(12) United States Patent
Massen

(10) Patent No.: US 9,056,465 B2
(45) Date of Patent: Jun. 16, 2015

(54) INK-JET PRINT HEAD WITH INTEGRATED OPTICAL MONITORING OF THE NOZZLE FUNCTION

(75) Inventor: Robert Massen, Öhningen (DE)

(73) Assignee: BAUMER INNOTEC AG, Fraunfeld (CH)

( * ) Notice: Subject to any disclaimer, the term of this patent is extended or adjusted under 35 U.S.C. 154(b) by 0 days.

(21) Appl. No.: 13/995,728

(22) PCT Filed: Dec. 21, 2010

(86) PCT No.: PCT/EP2010/007811

§ 371 (c)(1), (2), (4) Date: Jul. 26, 2013

(87) PCT Pub. No.: WO2012/083980

PCT Pub. Date: Jun. 28, 2012

(65) Prior Publication Data

US 2013/0293625 A1 Nov. 7, 2013

(51) Int. Cl.

| | |
|---|---|
| ***B41J 29/393*** | (2006.01) |
| ***B41J 2/125*** | (2006.01) |
| ***B41J 2/045*** | (2006.01) |
| ***B41J 2/165*** | (2006.01) |
| ***B41J 2/21*** | (2006.01) |

(52) U.S. Cl.

CPC ..... *B41J 2/125* (2013.01); *B41J 2/04561* (2013.01); *B41J 2/16579* (2013.01); *B41J 2/2142* (2013.01)

(58) Field of Classification Search

CPC ..... B41J 2/04561; B41J 2/04558

See application file for complete search history.

(56) References Cited

U.S. PATENT DOCUMENTS

| | | | | |
|---|---|---|---|---|
| 4,510,504 | A | 4/1985 | Tamai et al. | |
| 6,350,006 | B1 | 2/2002 | Muller et al. | |
| 6,786,568 | B2 | 9/2004 | Greive | |
| 2001/0043246 | A1 * | 11/2001 | Taneya et al. | 347/19 |
| 2002/0012020 | A1 * | 1/2002 | Sarmast et al. | 347/19 |
| 2005/0078138 | A1 * | 4/2005 | Koyama | 347/19 |
| 2005/0083361 | A1 * | 4/2005 | Nakanishi et al. | 347/12 |
| 2009/0058921 | A1 * | 3/2009 | Habashi | 347/29 |
| 2009/0096826 | A1 | 4/2009 | Hayashi | |

(Continued)

FOREIGN PATENT DOCUMENTS

| | | |
|---|---|---|
| DE | 10239002 | * 11/2001 |
| EP | 908315 A2 | * 4/1999 |

(Continued)

OTHER PUBLICATIONS

Machine generated English translation of JP2004-209734A to Uenishi, "Print Inspection Device of Ink Jet Printer"; generated via http://www19.ipdl.inpit.go.jp/PA1/cgi-bin/PA1INDEX on Aug. 27, 2014; 7 pp.*

(Continued)

*Primary Examiner* — Shelby Fidler

(74) *Attorney, Agent, or Firm* — McGlew and Tuttle, P.C.

(57) ABSTRACT

An inkjet printer for producing graphic or functional products, the inkjet printer having integrated optical monitoring of the correct function of each of the nozzles that shoot the ink onto the substrate. For this purpose, the drops ejected from the nozzles are illuminated from the direction of the ejecting nozzles, and the light reflected backwards from the drop flying away is conducted onto light-sensitive sensors during the flight of the drop.

14 Claims, 8 Drawing Sheets

(56) References Cited

U.S. PATENT DOCUMENTS

| | | | | |
|---|---|---|---|---|
| 2009/0184993 | A1 | 7/2009 | Yorimoto et al. | |
| 2013/0182031 | A1 * | 7/2013 | Govyadinov et al. | 347/19 |
| 2013/0320198 | A1 * | 12/2013 | Govyadinov et al. | 250/208.2 |

FOREIGN PATENT DOCUMENTS

| | | | | |
|---|---|---|---|---|
| EP | 2 033 791 | A2 | | 3/2009 |
| JP | 2004209734 | A | * | 7/2004 |
| WO | 91/00807 | A1 | | 1/1991 |
| WO | 2007/007070 | A1 | | 1/2007 |

OTHER PUBLICATIONS

Chry Lynn: "Drops and Spots: Latest Trends in Inkjet Printheads and Printer Design"; SGIA Journal, 4th quarter 2009, pp. 14-17.

The dissertation by Jia Wie "Silicon MEMS for Detection of Liquid and Solid Fronts", TU Delft, Jul. 13, 2010, Chapter 4: "Liquid Surface Position Detection for Inkjet Meniscus Monitoring".

K. Nagata et al. in the journal Ceramurgia International, vol. 3, Edition 2, 1977, pp. 53-56, published by Elsevier Sciences Ltd, in a contribution with the title "Vacuum Sintering of Transparent Piezo-Ceramics".

* cited by examiner

INK-JET PRINT HEAD WITH INTEGRATED OPTICAL MONITORING OF THE NOZZLE FUNCTION

CROSS REFERENCE TO RELATED APPLICATIONS

This application is a United States National Phase Application of International Application PCT/EP2010/007811 filed Dec. 21, 2010, the entire contents of which are incorporated herein by reference.

FIELD OF THE INVENTION

The invention pertains to an ink-jet printer for printing a substrate with graphic and/or functional inks. The ink jet printer has at least one print head.

BACKGROUND OF THE INVENTION

For numerous industrial decoration tasks, for example the decorative printing of floors and furniture surfaces, the production of classic print media, in packaging printing, but also in so-called functional printing like the creation of printed circuits, solar cells, bio-chips etc., high-resolution industrial ink-jet printers are replacing classic printing methods such as offset, gravure and screen printing.

Within the framework of this specification, the term "ink" and "ink-jet printing" are to be understood in the most general sense. While in the production of graphic finished products such as posters, printed packaging etc. ink in the narrower sense is actually ejected through the print heads in the form of minute drops onto the substrate to be printed, such as paper, foil, cardboard, textiles etc. and designs these in color, in so-called "functional" ink-jet printing, special fluids are also ejected onto a substrate using basically the same principle in the form of minute drops in order to create a chemo-physical function on this substrate: argentiferous fluids to create printed conductors, molecular-biologically active fluids to create so-called bio-chips, semi-conductor fluids to "print" screens etc. All of these processes are often referred to under the vague term of "digital printing".

At least in the industrial sector, this so-called "digital printing" uses mainly piezoceramic, so-called drop-on-demand, print heads, in which through piezoelectrically generated shear and/or compressive forces minute ink drops of typically 10 picoliters per drop are ejected onto the substrate to be printed through a large number of closely adjoining nozzles with repetition rates of up to 20 kHz.

Besides the undisputed advantage of the more or less direct transmission of an electronically saved file onto a physical carrier and the associated option of printing very small batches etc., however, a basic weak point remains. Through the extremely high number of nozzle switching operations per unit area, for example approximately 100 million per square meter on a furniture panel to be decorated, the probability of the temporary or complete failure of a nozzle is not negligible.

Typical nozzle faults are nozzles blocked by dirt in the ink, sedimentation or air bubbles, nozzles that do not close properly or nozzles that function irregularly. While numerous new developments like the so-called "side-shooter" nozzle heads by the company Xaar (www.xaar.com) reduce the likelihood of such malfunctions, they cannot rule them out completely. The problem of nozzle failure is described in, among other articles, Chry Lynn: "Drops and Spots: Latest Trends in Inkjet Printheads and Printer Design"; SGIA Journal, 4th quarter 2009, pp. 14-17.

Since technological developments are moving towards higher and higher-resolution print heads with higher and higher switching frequencies, this inherent problem will increase and hinder the further propagation of a cost-effective and technically highly interesting technology.

Very early in the history of the development of ink-jet printers for digital printing, there were efforts to monitor the correct functioning of ink-jet printers.

Basically, this monitoring can take place on two levels:

a) the monitoring of each individual ink ejection nozzle for correct drop ejection by means of a sensor, as a rule contactless, and
b) the monitoring of the printed result, as a rule through the image-generating recording of the printed substrate (paper, wood panel, solar cell glass etc.) in a camera-based process.

As early as 1991, the company Siemens AG, Munich, had described a process in WO 91/00807 in which the ejection of the (warm) ink drop from the nozzle was contactlessly detected with the help of a thermal sensor.

The U.S. Pat. No. 6,350,006 also teaches how the optical density of the ink curtain formed by the drop ejection is monitored with the help of photosensors.

In its large industrial ink-jet printer HPT300 Color Inkjet Web Press, the company Hewlett-Packard uses its own camera-based image processing system, which records a test sample printed at periodic intervals and in this way detects nozzle faults.

As a rule, the effect of the recognition of a malfunction in an ink-jet print head is to stop current production and to service/clean the print heads affected. There is no doubt that stopping production temporarily in this way reduces productivity significantly and is thus very expensive.

In addition, there have been a number of proposals to minimize the visual effect of unavoidable printing faults, that is, in the event of a printing fault to take measures to minimize the visual effect of the non-functioning nozzles without stopping production.

For example, the U.S. Pat. No. 6,786,568 B2 describes a method of printing over faulty areas with a special ink with the help of a number of additional nozzles in order to cover up optical detection. A precondition for this, however, is a sufficiently robust detection of faulty nozzle functioning.

The dissertation by Jia W I E "Silicon MEMS for Detection of Liquid and Solid Fronts", T U Delft, 13 Jul. 2010, Chapter 4: "Liquid Surface Position Detection for Inkjet Meniscus Monitoring" also describes how the correct formation of the ink meniscus can be monitored capacitively with the help of extremely miniaturized sensors within an ink-jet nozzle.

Despite these prior-art methods for monitoring the individual nozzles of an ink-jet printer, ink-jet print heads are seldom supplied and used with an integrated individual nozzle monitoring system today due to the unreliability and complexity of these additional monitoring organs. End customers make do with frequent printing and the evaluation of test samples and have so far accepted the associated production downtimes.

SUMMARY OF THE INVENTION

There is therefore great economic and technological interest in a procedure, and a configuration for carrying out the procedure, to allow the production and operation of ink-jet print heads which have an integrated, reasonably priced monitoring system for the individual nozzles and as few additional operations and components as possible.

According to the invention an ink-jet printer is provided for printing a substrate with graphic and/or functional inks which has at least one print head. The printer includes an optical device that is integrated in the print head(s) to monitor the correct functioning of the ink-jet nozzles, which illuminates the drops ejected from the nozzles by means of the light from a light source from the direction of the nozzles through the print head by means of illumination signals which are either constant in time or changeable in time. The optical device has at least one light-conducting element through which the light reflected by the drop ejected from the nozzle during the flight of the drop can be conducted backwards in the direction of the nozzles onto light-sensitive sensors, or photosensors, and whereby an evaluation device is provided for to examine the correct form and the correct ejection of the drop, concluded from the specific timing of the sensor signal.

The ink-jet printer to which the invention relates thus has an integrated optical system to monitor the correct functioning of each of the nozzles ejecting the ink onto the substrate. In this process, the drops ejected by the nozzles are illuminated from the direction of the ejecting nozzles and the light reflected backwards from the ejected drop is conducted onto the light-sensitive sensors during the flight of the drop. From the specific timing of these electric sensor signals, the correct functioning of the nozzles can in principle even be examined for each individual drop.

In other words, in accordance with the invention, an optical system integrated in the print head monitors the drop ejection of each individual nozzle in that the ejected drops are illuminated upward by a light source through one or more transparent parts of the print head, whereby the light reflected from the drops ejected from the nozzle is conducted back via one or several transparent parts of the print head onto at least one photosensor.

The conduction of the illuminating light to the drop being ejected from the nozzle, as well as the conduction of the light reflected back in the direction of the nozzle from the drop during its flight are preferably performed by at least partially transparent and light-conducting parts in the print head.

In particular, the configuration can be miniaturized through the use of transparent and light-conducting piezoceramics so that each individual nozzle can be monitored. In accordance with a preferred embodiment of the invention, therefore, a piezoceramic print head is provided for, consisting at least in some areas of light-conducting ceramic material, whereby the light source and the light-sensitive sensors are arranged in such a way that the conduction of the light from at least one light source or the conduction back of the light reflected by the drops ejected by the nozzles is effected through the light-conducting ceramic material.

The transparent parts of the print head can be formed by the transparent and light-conducting piezoceramic material of the print head. Alternatively or additionally, light-conducting elements can be integrated in the print head, said elements conducting the light through the print head into the drop ejection area and from there back through the print head to a sensor.

The idea underlying the invention comprises a large number of illumination options. Among other things, the following configurations are possible within the framework of the invention:

a) the illumination of all drop ejection areas by one common illumination source; this may consist of continuous light or light pulsed in the rhythm of the drop ejection.

B) the pulsed illumination of only one drop ejection area and the examination of only the nozzle in question at this point in time. Such a design avoids any disruptive stray light and cross-talk between the individual channels.

C) combinations of the two scenarios a) and b), for example simultaneous illumination restricted to non-neighboring nozzle areas in order to prevent optical cross-talk.

Through rapid pulsation of the illumination, the reflections from the flying drops can still be recorded at discrete and known points in time. This can lead to a significant improvement in the signal-to-noise ratio, for example according to lock-in operation as known in signal processing, through synchronous reading-out of the image sensor.

This means that with the ink-jet printer to which the invention relates a procedure for examining the functioning of the ink-jet printer can generally be carried out, whereby the ink-jet printer has a print head with several nozzles, photosensors assigned to the nozzles and at least one light source, whereby during printing on a substrate, and during the ejection of an ink drop, light from a light source is conducted through at least one light-conducting element through the print head to the drop ejection side of the print head, the light is reflected by a drop generated and ejected by the print head, is coupled back into a light-conducting element of the print head and conducted through the light-conducting element to a photosensor assigned to the nozzle which ejects the ink drop, and whereby the signal emitted by the photosensor is evaluated in that the signal is compared with reference values and in that, in the event of a deviation of the signal from the reference values, a malfunction of the nozzle is detected. The reference values can also be reference ranges, or can define reference ranges.

The invention shall be described in greater detail in the following with the help of embodiments and the enclosed figures. The same reference signs in the figures refer to the same or corresponding elements. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
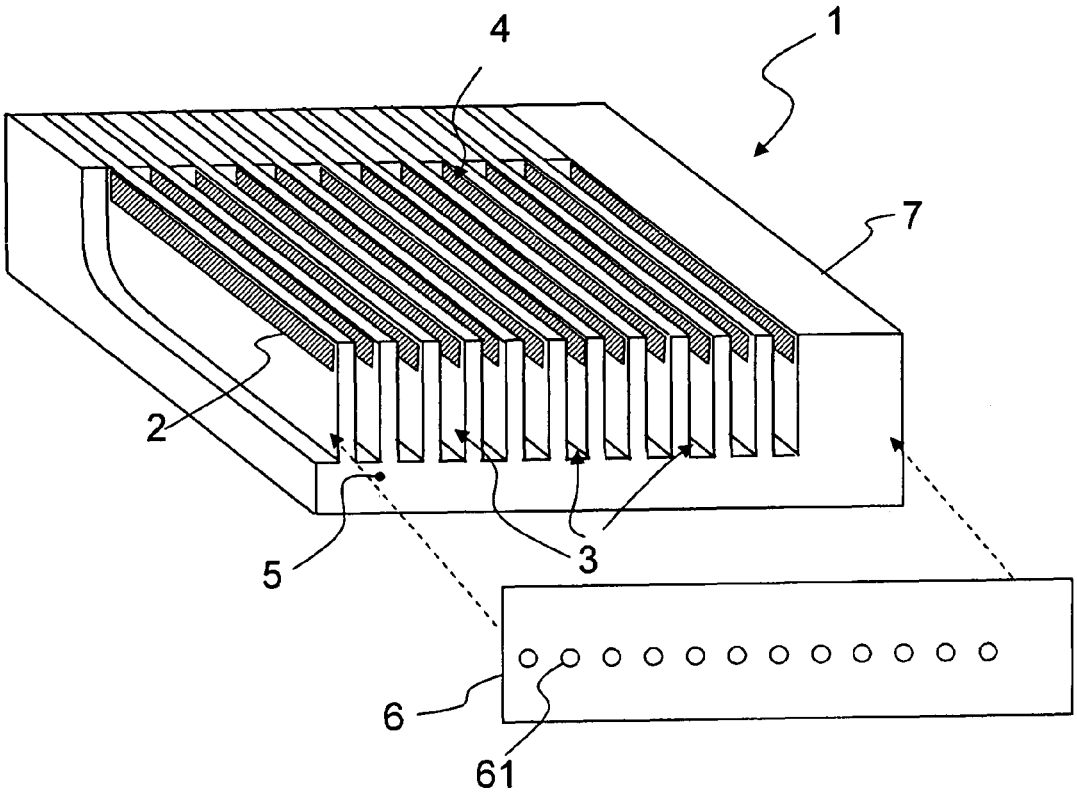
FIG. 1 is a diagrammatic view of a piezoceramic print head in accordance with the "side-shooter" principle.

Referring to the drawings in particular, FIG. 1 initially shows a view of a piezoceramic print head 1 in accordance with the "side-shooter" principle. The print head comprises an opaque piezoceramic base body 7 in which ink channels 3 with a rectangular cross section are located. The ink is fed simultaneously to each of the elongated channels 3 from side 4, to which the channels 3 are open. The base body is closed by a cover element 8, which closes side 4 in the design shown in FIG. 1. For greater clarity, the cover element is not shown in FIG. 1.

The ribs between the elongated channels are fitted with two-dimensional electrodes 2. To eject a drop of ink, a driving current is applied to these, creating shear forces in the piezoelectrical material and thus deforming the channel walls. This rapid deformation transmits a pressure impulse to the ink in the channel, so that this is ejected on the front side 5 as a minute droplet. This sudden pressure surge drives a very small drop with a typical volume of several tens of picoliters, for example about 40 picoliters, out of the nozzle on the front side 5. To form the droplet, a diaphragm or nozzle plate 6 with one nozzle aperture 61 per channel 3 is mounted on the front side 5; for reasons of clarity, however, this is shown separate from the front side 5 in FIG. 1. Furthermore, ejection frequencies of 5000 to 20,000 droplets per second are typical. Without restriction to the embodiments described, a further development of the invention provides for the driving current, the nozzle size and the ink (in particular its surface tension and viscosity) being chosen in such a way that when the driving current is applied, a droplet of the size of 10 to 100 picoliters is produced.

The print head shown in FIG. 1 has twelve channels 3. The number of nozzle channels 3 can of course be varied almost indefinitely.

The piezoceramic base body is typically produced from PLZT ceramics. In accordance with the invention, it is now intended to produce and/or to use this piezoceramic base body at least partly from transparent and light-conducting PLZT ceramics or a similar light-conducting piezoceramic material.

The production of such piezoceramic materials, which are at least transparent in limited wavelength ranges, is described by the authors K. Nagata et al. in the journal Ceramurgia International, Volume 3, Edition 2, 1977, Pages 53-56, published by Elsevier Sciences Ltd, in a contribution with the title "Vacuum Sintering of Transparent Piezo-Ceramics". Accordingly, the transparent piezoelectric materials described therein are also, in full, made the subject matter of the invention.

In WO 2007/007070 A1 of Oct. 7, 2006, Gillespie et al. also describe such optically transparent piezoceramic materials made of lithium niobate.

Within the framework of this application, the terms "transparent", "optically conductive" and "light" are to be understood in the widest sense; the light in question can be in the range visible to the human eye, but may also be in invisible wavelengths; it can be wide-band or narrow-band, incoherent or coherent. In accordance with the invention, a light source is also understood not only as a constant light source but also a switched light source.

This extended term also relates to the propagation of light within a so-called "transparent" piezoceramic material. Accordingly, this "transparency" or "light conducting capability" can be wide-band or narrow-band, directional or diffuse.

Figure 2:
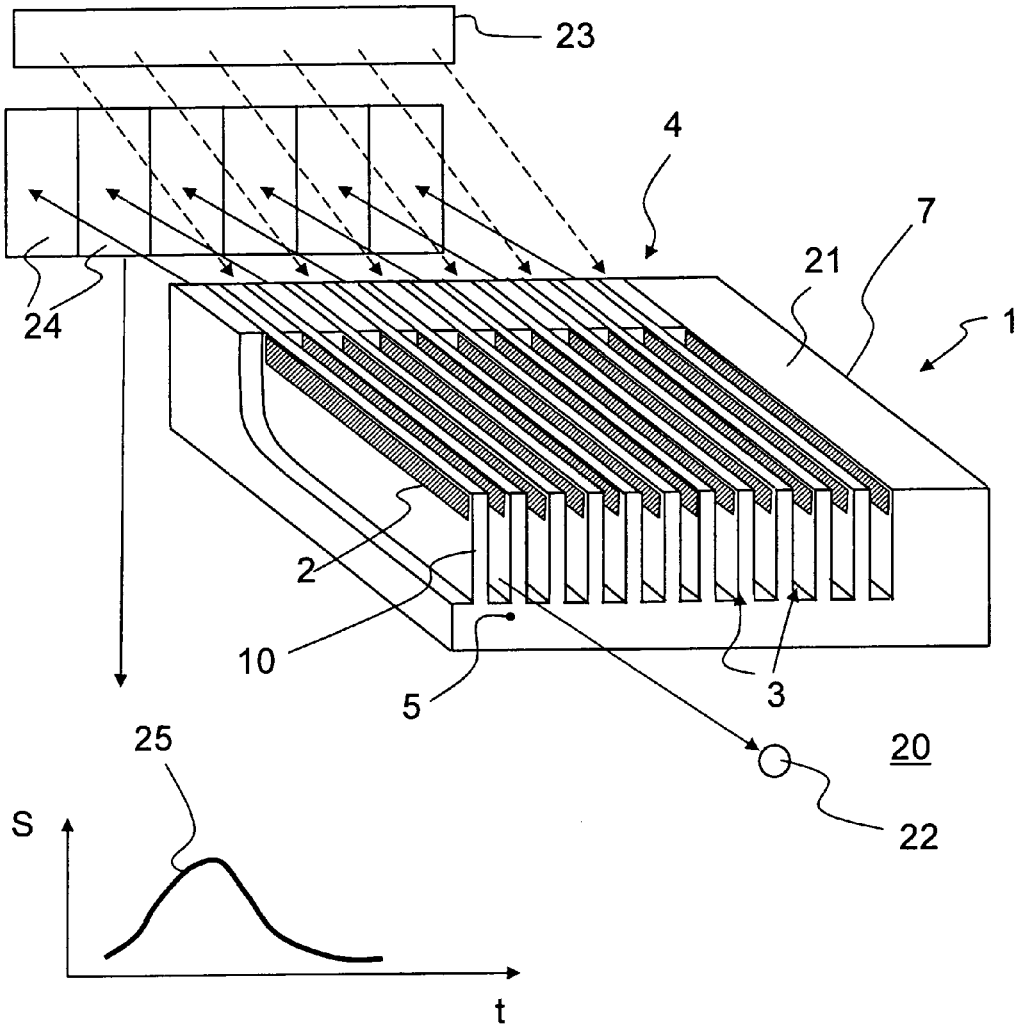
FIG. 2 is a diagrammatic view showing a further development of a print head in accordance with the invention.

FIG. 2 shows a development of a print head to which the invention relates in accordance with FIG. 1. Here, the base body 1 comprises a transparent, light-conducting, piezoceramic material 21. By means of a light source 23, light is simultaneously coupled into every second transparent rib 10 of the base body 1. The light is coupled out again on the front side 5 of the print head. This allows the illumination of ejected drops 22 by a light source 23 which for reasons of space could not be located between the print head and the substrate to be coated located opposite the front side 5, or could only be located there with great difficulty. The retransmission of the light reflected from the drop 22 can be effected via the neighboring ribs that are not illuminated by the light source 23. Photosensors 24 on the back of the print head 1 are assigned to these non-illuminated ribs 10, and detect the reflected light that is conducted back through the ribs 10. Without restriction to the embodiment shown in FIG. 2, therefore, the ribs 10 are used as component parts of the integrated optical device with which the light is conducted through the print head. Accordingly, this embodiment of the invention is based on the print head having ink channels which are limited by ribs 10, with the ribs 10 being component parts of the optical device and being transparent for the light from the light source 23, and with the light source 23 and the photosensors being arranged in such a way that the ribs conduct the light from the light source through the print head onto an ejected drop, or conduct the light reflected by an ejected drop through the print head to a photosensor.

In order to be able to monitor the process of the correct droplet formation for each nozzle through an integrated device and a suitable method, in accordance with the idea underlying the invention, therefore, it is intended to produce, and use, the base body 1, at least in some parts, from piezoceramic material 21 that is transparent for the light from a light source, without restriction to the embodiment of the invention shown in FIG. 2. Such transparent piezoelectric materials are suitable for conducting the light from a light source 23 into the drop ejection area 20 for purposes of illumination and for conducting the light reflected by an ejected drop 22 back to one or more photosensors 24.

To achieve this, light is coupled out of the light source 23 and into every second transparent rib 10 from the rear side 7 for the illumination of the drop ejection area 20. This light is conducted along the rib into the ejection area 20 and there illuminates the ejected drop 22 approximately in the direction of the drop trajectory. The light reflected back from the drop is for example collected via the neighboring channel wall rib that is not illuminated by the light source 23 and conducted through the light-conducting rib 10 to the rear side of the print head 1 and coupled into a 4-fold photosensor 24. The electric signal S generated by the photosensor, reference 25, shown as an example in FIG. 2, thus represents the amount of light reflected by the ejected drop over time t in the form of a temporal voltage or current characteristic.

The idea underlying the invention therefore comprises two innovations compared with prior art:

a) instead of observing the drop ejected from the nozzle for example with a camera from a position at right angles to the trajectory, the drop is observed in the direction of its trajectory from the nozzle until it strikes the substrate, preferably not generating an image b) instead of recording an image of the drop at different points in time from a side view and spatially resolved, the quantity of light reflected back by the flying drop is measured in a time-resolved manner.

Since, as described above, in the embodiment shown in FIG. 2, the light from the light source is coupled in, and the light reflected from the drop is detected on the rear side of the print head in each case, this embodiment of the invention is also based on the following features:

The print head has a front side 5 from which ink droplets can be ejected, and a rear side located opposite the front side.

The light source is arranged in such a way that its light is coupled into the rear side and conducted through the print head 1 to the front side 5.

The photosensors 24 are arranged in such a way that light reflected from the ejected drops, entering the front side and being conducted through the print head 1 to the rear side, can be detected by the photosensors 24.

Figure 3:
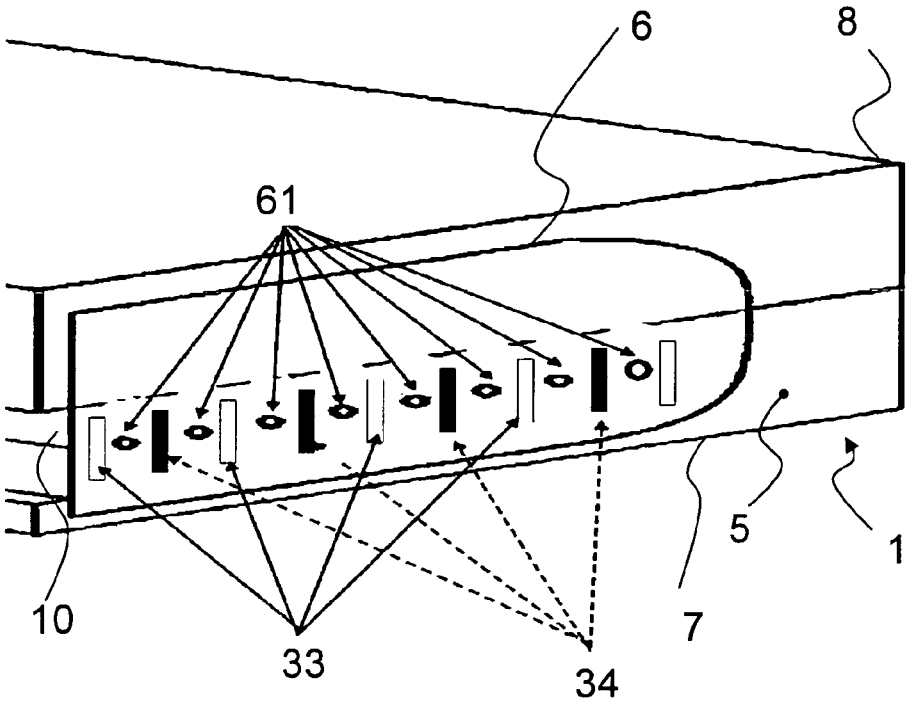
FIG. 3 is a diagrammatic view showing embodiment of a print head with a nozzle plate 6 which has cutouts or windows in order to couple out the light used to illuminate the drop ejection area from the transparent and light-conducting channel ribs located behind them, as well as to couple the light reflected from an ejected drop during its flight back into channel ribs and to conduct it to photosensors located at the back of the print head.

FIG. 3 shows a sketch of the nozzle plate 6 with, in this example, N=8 nozzle apertures 61 as well as the N=8 optical apertures or windows used for conducting light to the channel ribs 10 made of transparent piezoceramic material, whereby half of these apertures 33 allow light to be emitted for illumination purposes and the other half of these apertures 34 receive the light reflected back by the drop and transmit this to the photosensor on the print head rear side located opposite the nozzle plate. In accordance with this further development of the invention, it is therefore generally intended that the print head should have a nozzle plate 6 in which the nozzles 61 for the drop ejection are located, whereby the nozzle plate has windows or cutouts in order to couple out the light from the light source 23 conducted through the print head or to couple in the light reflected from a droplet into the print head. The entire nozzle plate 6 can also be designed as a window if the nozzle plate 6 is made of transparent material. In accordance with a further development of the invention, the ejection apertures, windows or cutouts are closed by generally beam-shaping, in particular also imaging or focusing optical elements. Accordingly, beam-shaping, in particular also focusing optical elements can generally be located on the nozzle plate. The following may be used:

a) beam-shaping optics which concentrate the illumination on the intended trajectory of the ink drops b) imaging optics which concentrate the light reflected from the drop on the apertures in the nozzle plate which transmit the light onto the photosensors 24.

These optics are preferably formed from diffractive optical elements which are particularly easy to produce when narrow-band illumination is used.

In the examples shown in FIG. 2 and FIG. 3, as described above, light is conducted to the drop ejection area 20 through first ribs 10 and light reflected there is conducted through neighboring or intermittently located second ribs back through the print head to the sensors. Accordingly, in a further development of the invention, without restriction to the special examples shown in FIG. 2 and FIG. 3, it is intended that the light source 23 and the detectors 24 are arranged in such a way that first ribs conduct light from the light source 23 to the drop ejection side of the print head, in this case the front side 5, and second ribs conduct light reflected by the drops through the print head 1 to the photosensors 24, with the first and second ribs being arranged alternately.

Figure 4:
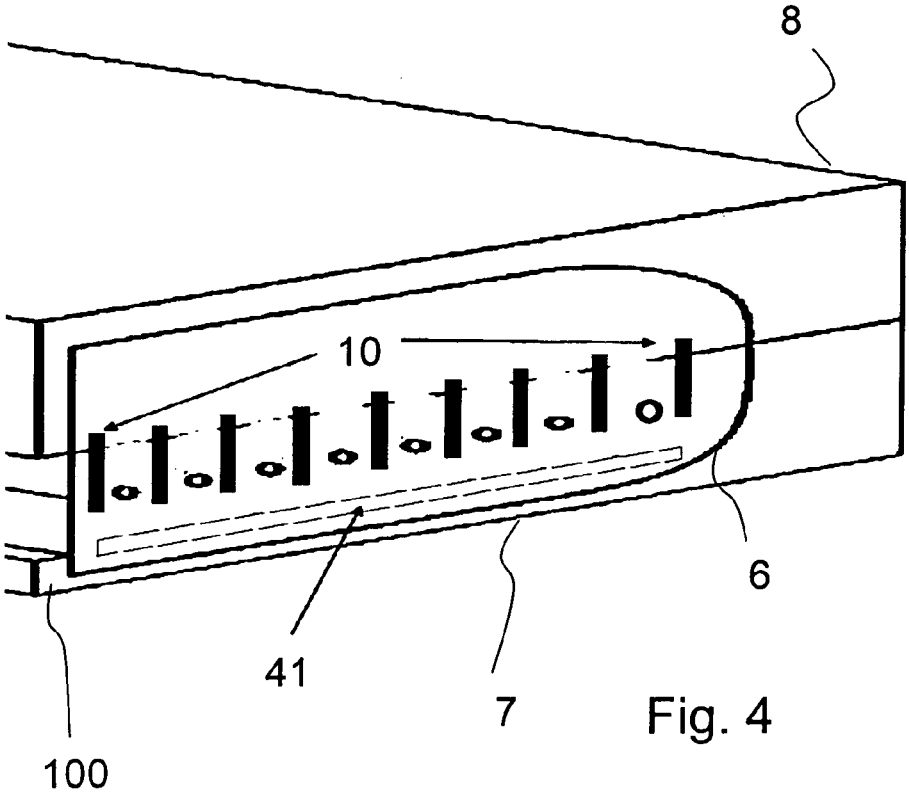
FIG. 4 is a diagrammatic view showing an alternative embodiment with an illumination slit 41 extending over the entire width of the print head and with for example N=9 apertures 42 in order to couple the light reflected back from the ejected drop during its flight into the light-conducting channel ribs leading to the photosensors at the back of the print head.

FIG. 4 shows an alternative or additional design of the arrangement in which the light-conducting ceramic base part 100 of the print head 1 is used to conduct illuminating light into the drop area. This light, which is in turn coupled in on the rear side, is emitted in a slit form in the lower part of the nozzle plate 6. In this variant of a common illumination for all N=8 nozzle areas in this example, all channel ribs 10 can be used via the appropriate nozzle slits as receivers for the light reflected by the ejected drops. Accordingly, a photosensor 24 can thus be provided on the rear side for each channel rib 10.

FIGS. 3 and 4 also show the cover element 8, which closes the slit-shaped ink channels laterally.

The embodiment of the invention shown in FIG. 4—without restriction to the development shown as an example—is therefore based on the print head having a piezoceramic base body 7 which is closed by a cover element 8, whereby the piezoceramic base body has a light-conducting ceramic base part 100, with the light source 23 being located in such a way that its light is conducted through the ceramic base part 100 to the side of the print head with the nozzles, that is, the front side 5.

Figure 5:
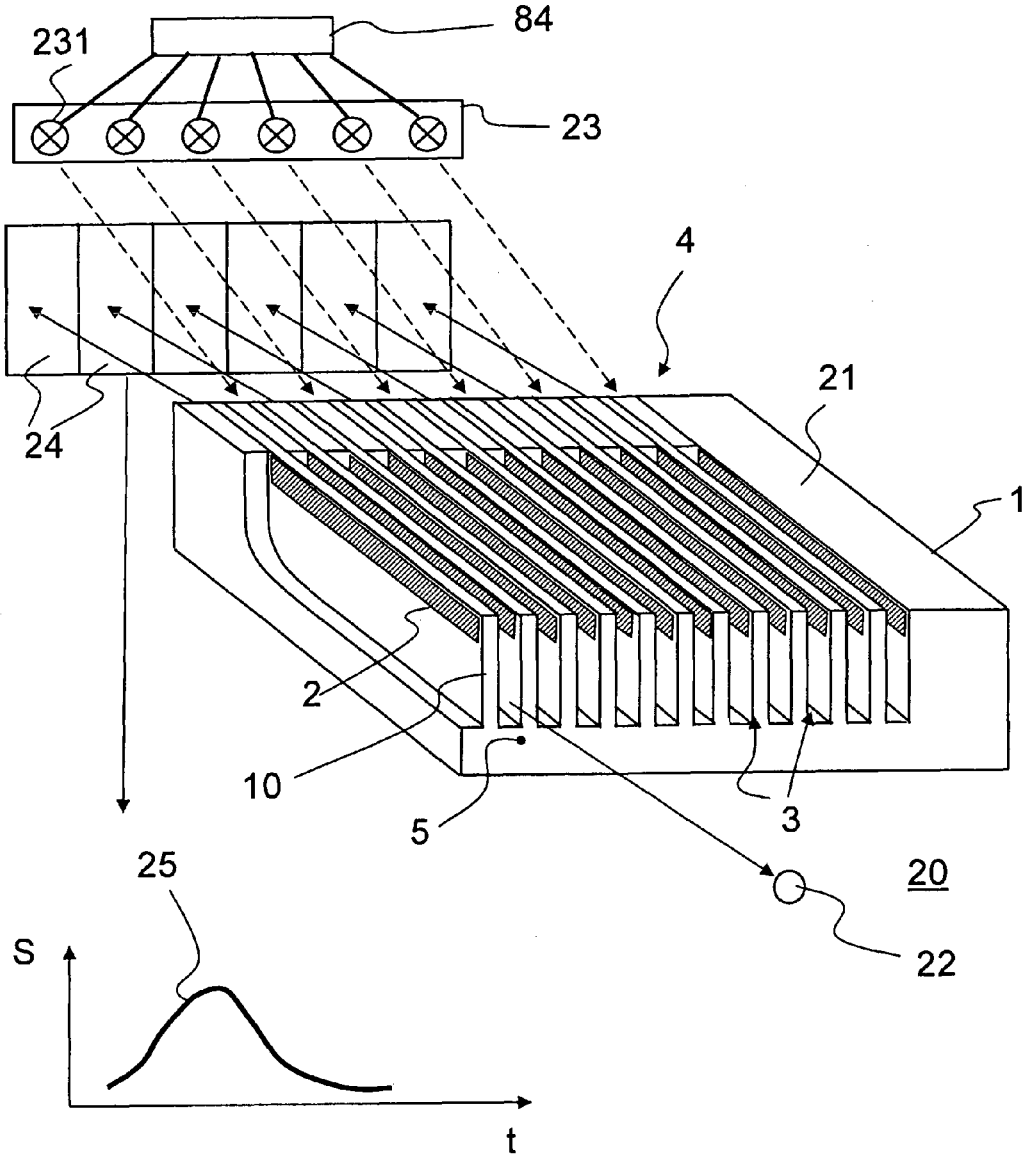
FIG. 5 is a diagrammatic view showing an alternative development of the embodiment shown in FIG. 2.

FIG. 5 shows an alternative development of the embodiment shown in FIG. 2 with principally the same design, but with the difference that each of the illuminating ribs 10 of the print head 1 is illuminated by a separate light emitter 231 which can be switched individually in the rhythm of the drop ejection and that individual drop channels can selectively be optically monitored without any disruptive optical cross-talk caused by neighboring nozzles. Accordingly, the light source 23 here comprises several light emitters 231 which are arranged in such a way that one emitter only illuminates one channel rib 10, whereby an illumination control unit 84 is provided to switch on a light emitter 231 when an ink channel 11 belonging to the channel rib 10 or limited by the channel rib 10 is actuated in order to eject an ink drop, so that the ejected ink drop is illuminated through the print head by the light emitter 231. In other words, therefore, each of the illuminating ribs is illuminated by a separate light emitter 231 actuated in the rhythm of the ink ejection so that a channel rib only ever illuminates the ejection area assigned to it at the point in time of the drop ejection or within a time window that includes the ejection of the drop. To achieve this, rapidly pulsating light-emitting diodes are preferably used as light emitters. This further development of the invention is also not restricted to the special embodiment of the invention with light-conducting ribs 10, but can generally be used for light-conducting elements as component parts of the print head. Accordingly, the development of the invention generally provides that the light source 23 comprises several light emitters 231, whereby each light emitter 231 is assigned a light-conducting element into which the light from the light emitter can be coupled and whereby the light emitters 231 are assigned different nozzles, and the light-conducting elements are arranged in such a way that light conducted through a light conductor locally illuminates the area in front of the print head into which drops can be ejected from an assigned nozzle, and whereby an illumination control unit 84 is provided and is set up so that it actuates the light emitters 231 individually when a drop is ejected through an assigned nozzle 61.

Figure 6:
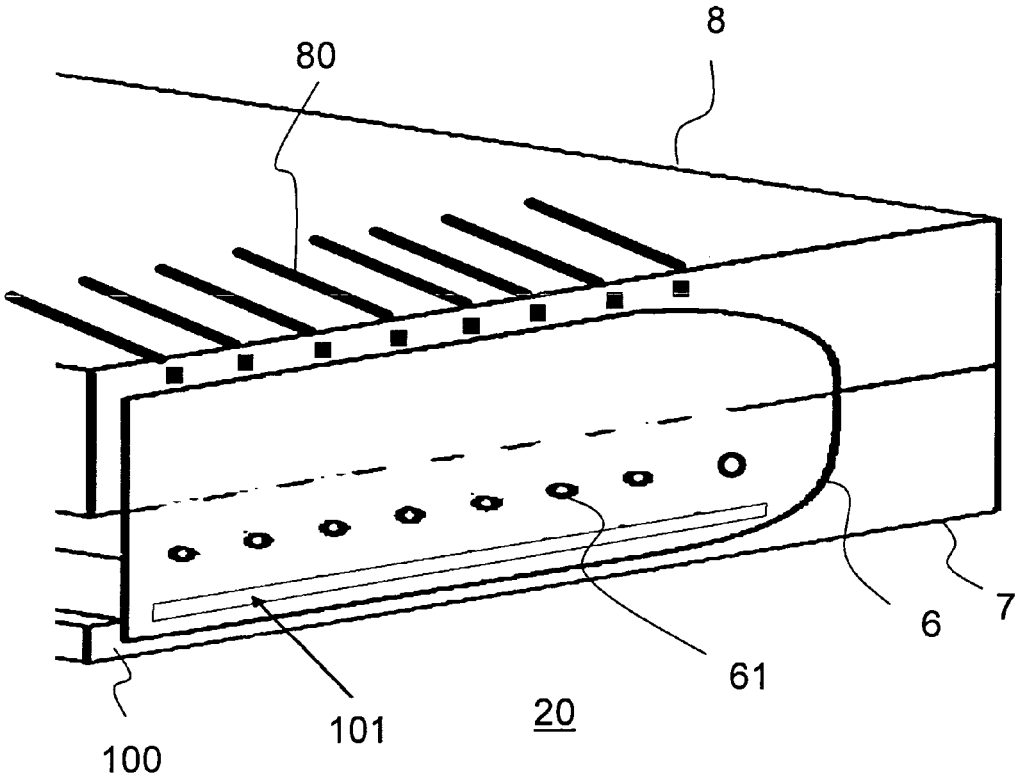
FIG. 6 is a diagrammatic view showing a further embodiment of the invention.

FIG. 6 presents an example of a particularly simple design of forward illumination and the conduction of the light reflected back by the drop during its trajectory to the photosensors 24. In this embodiment the drop ejection area 20 is illuminated in a slit or fan shape by the transparent ceramic base part 100 and the light reflected by the drop is conducted via light-conducting zones or structures 80 embedded in the ceramic cover element 8, for example embedded glass fibers, back to the photosensors 24 on the rear side of the ink jet head.

In a similar way as in the embodiment shown in FIG. 4, therefore, the drop ejection area 20 is illuminated in a slit-shaped form over the entire width through a light-conducting zone 101 in the base part 100 of the base body 7 of the print head 1. The light-conducting zone 101 may be formed by the base part 100 itself, or an area of the base part 100 is designed to be light-conducting.

As an alternative to integrated light conductors, the reflected light can also be absorbed in the form of a slit over the entire width of the cover element 8 and conducted through the cover element 8 to the rear side of the print head 1. With this very simple arrangement, however, it may only be possible to evaluate scenarios in which only one nozzle is active, so that no signals from several simultaneously ejected drops cause disruptive interference.

Figure 7:
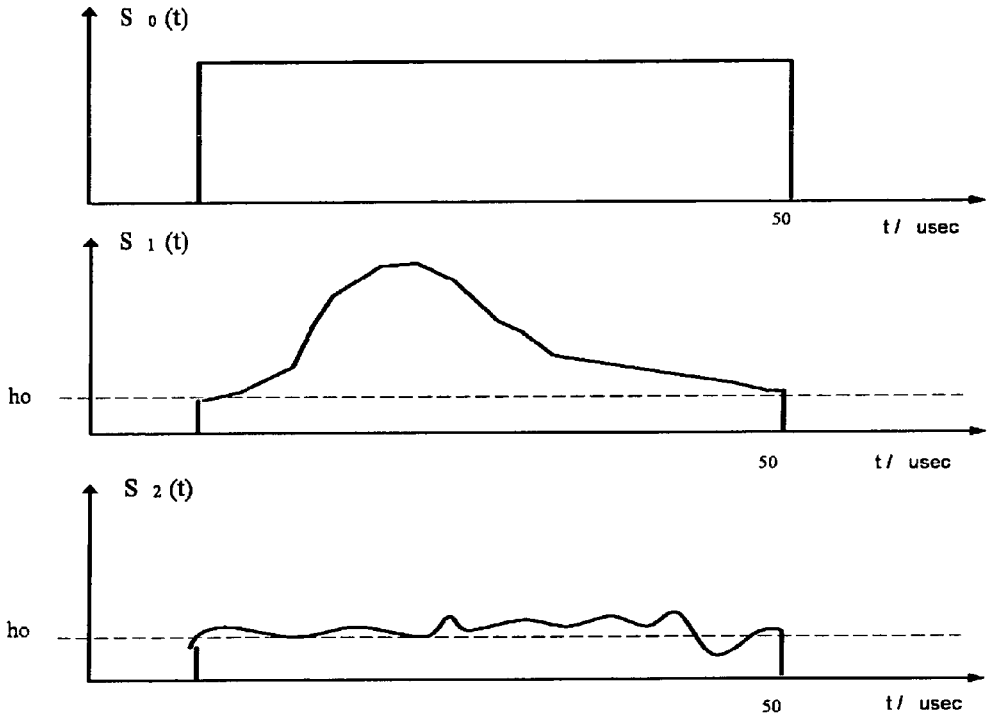
FIG. 7 is a view of signal sequences like those obtained with a configuration in accordance with the invention with photosensor and the illumination of an ink drop through the print head. The top diagram shows the signal sequence S0(*t*) of an illumination impulse fed in from the light source, the center diagram the signal sequence S1(*t*) of the light reflected back by the correctly ejected drop during its flight and the lower diagram the signal sequence S2(*t*) of the light reflected back by a missing or incorrectly formed drop, applied over the time t of the flight duration.

With the help of three diagrams, FIG. 7 illustrates the voltage signals generated by the photosensor 24 as a function of time. This example uses a pulsed light source, as explained as an example in the embodiment shown in FIG. 5. The voltage curve S0(*t*) shown in the upper diagram represents the voltage pulse with which the illuminating light source 23 is actuated; the frequency corresponds to the drop frequency, typically 5 to 10 kHz; the pulse duration is preferably selected so that it is somewhat shorter than the flight duration of the ejected drop.

When a drop is generated and correctly ejected, the amount of light reflected onto the photosensor 24 generates a signal S1(*t*) shown in the middle diagram, which corresponds to the reflection of the backscattered illuminating light from the drop as it moves away from the ejection nozzle 61. As a rule, this signal is superimposed by a background signal ho, which comes from the unwanted reflection of the infed light, a reflection that does not come from the flying drop. Such unwanted background signals may also come from unavoidable optical coupling between the channel walls, neighboring drops or the substrate to be printed. However, since they are generally constant, they can easily be measured and compensated for, continuously or at specified intervals.

In the event of a missing or incorrectly shaped drop, a significantly different signal S2(*t*) is generated, and the excessively small amount of light reflected back by the missing drop can easily be detected. Such a signal is shown as an example in the lower diagram in FIG. 7.

Figure 8:
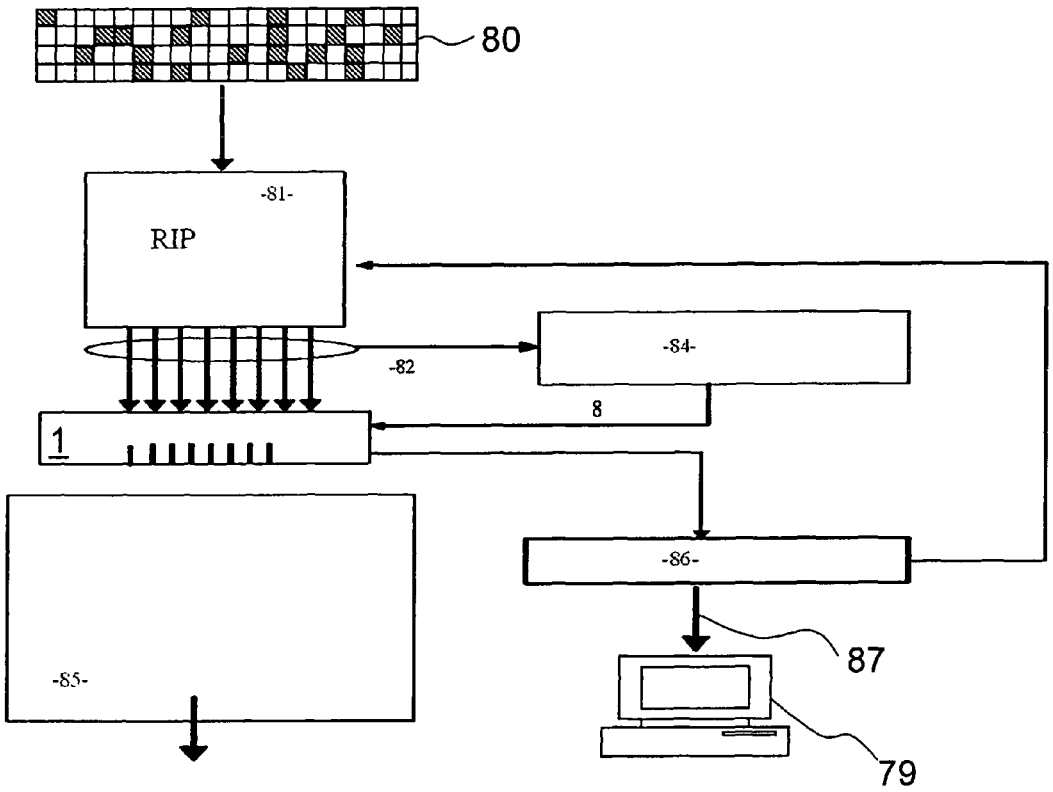
FIG. 8 is a circuit as a block diagram for controlling the illumination and evaluating the light signals.

FIG. 8 shows a block diagram for a control and evaluation circuit for controlling the print head to which the invention relates. This control and evaluation circuit comprises devices for controlling the illumination and evaluating the light signals received by the photosensors 24, that is, the evaluation device to which the invention relates.

The control and evaluation circuit comprises a raster image processor (RIP) 81. This generates actuation signals 82 for the nozzles of the print head 1 on the basis of a file to be printed 80. With the help of the same actuation signals 82 or signals derived from these actuation signals, the illumination control unit 84 is actuated. In accordance with this further development of the invention, it is intended that the ink-jet printer should comprise a raster image processor 81 which is set up to convert the data of a print file into actuation signals for the nozzles of the print head 1, whereby the print head 1 is set up to eject ink drops out of the nozzles as a reaction to the actuation signals, and whereby the illumination control unit is set up to individually actuate the light emitters 231 assigned to the nozzles for which the actuation signals are intended.

The droplets emitted by print head 1 print a substrate 85 which moves by known means in relation to the print head 1 during printing in order to generate a two-dimensional printed image corresponding to the print file.

With the embodiment shown in FIG. 8, the illumination and examination of the nozzles by the test unit 86 can be defined according to a desired rule. The result of the examination is communicated to a higher-order processing unit 79 via data lines 87. In accordance with a further development of the invention, the information about non-functioning nozzles is sent back to the raster image processor 81 in order to generate local modifications to the print file 80 in order to make the fault created by the non-functioning nozzle appear visually less conspicuous. In general, therefore, in accordance with this further development of the invention, without restriction to the embodiment shown in FIG. 8, it is intended to use the evaluation device to modify a print file containing the data of a printed image as a reaction to the ascertainment that at least one of the nozzles of the print head is malfunctioning.

Figure 9:
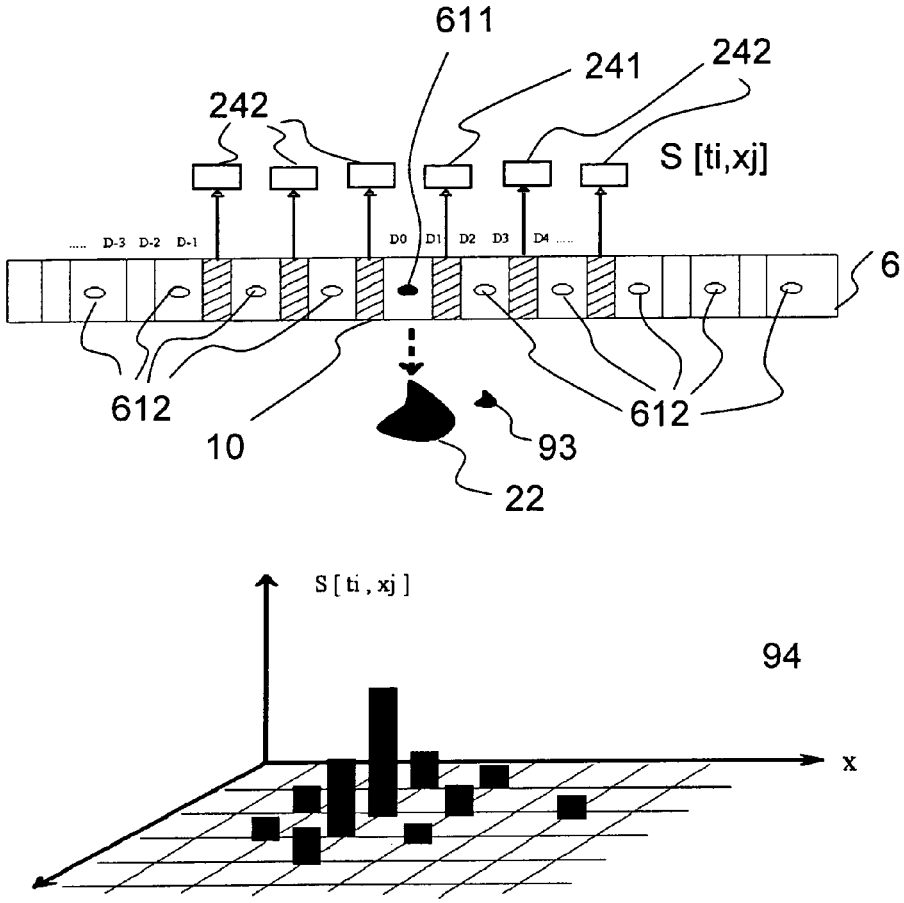
FIG. 9 is a view showing the recording of the reflections of a drop 22 created by a single active nozzle Do, 611 with several recording channels or through several adjacent photosensors.

Illumination scenarios in which a "redundant" nozzle is activated, i.e. when an active nozzle 611 is surrounded by K-1 inactive nozzles 612, are also interesting for the closer examination of a nozzle. As shown in FIG. 9 using the example of 9 nozzles 611, 612 of a nozzle plate 6, in this case, the photosensors 242, which are assigned to neighboring nozzles 612, or recording channels, can also be scanned in addition to the light sensor 241 assigned to the central active nozzle 611, or to the assigned recording channel. This means that additional information can be obtained and evaluated by the evaluation unit concerning the width of the ejected drop, its symmetry, any "satellite" droplets in the form of discrete 2-dimensional signal peaks S [ti, xi]. Through such a means of recording and evaluating signals, the disadvantages of a nozzle examination that is not image-generating or recorded with cameras can largely be compensated for.

If pulsed illumination as in the example shown in FIG. 5 is used, appropriate illumination scenarios can be derived directly from the signal of the raster image processor 81, which actuates the piezo-elements of the individual nozzles. If only one nozzle 611, 612 is to be examined at each print point in time, illumination and signal evaluation is only started when the raster image processor 81 effects one print head actuation in the course of which only one of the N nozzles is active.

To achieve this, in the circuit in accordance with FIG. 8, the file 80 to be printed is converted with the help of the raster image processor 81 into a rapid sequence of N-fold control signals 82 of the print head. This signal is fed into the illumination control unit 84, which generates the desired illumination and test sequence with the help of programmable parameters. Such possible test sequences may be:

a) per printed like only one nozzle is ever tested, b) per printed line only a few nozzles located far apart are ever tested, c) etc.

The maximum of N read-out reflection signals S1(*t*), like those shown as examples in the middle and bottom diagrams of FIG. 7, are evaluated by the test unit 86. By means of comparison with reference or target reflection signals, the quality and correct functioning of the nozzle 611 in question can then be evaluated.

The sensor signals of the photosensors 241, 242 can also be recorded and evaluated at several discrete points in time. In the diagram shown additionally in FIG. 9, at M=4 discrete points in time ti with simultaneously K=6 light recording channels, D-2 to D3 was recorded by photosensors 242, which are adjacent to photosensor 241. As examples, three channels to the left and 3 channels to the right of the nozzle 611 are evaluated using a total of 6 photosensors. This generates the two-dimensional place-time function S [ti, xj] as shown in the diagram.

The function values of the place-time function S [ti, xj] form discrete peaks 94, from which very much more accurate information can be obtained about the functioning of this nozzle and the generated drop formation, for example the occurrence of unwanted, so-called satellite droplets 93, than by recording the backscattered light through only two light recording channels on the left and right of the recording channel D0 of the active nozzle 611.

The evaluation of the received light signals by the evaluation unit can easily be carried out by comparing them with reference values. This means that the embodiment of the invention shown in FIG. 9 is in particular also based on the evaluation device being set up to evaluate the signals of neighboring photosensors which are assigned to non-activated nozzles, in addition to the signal of a photosensor which is assigned to a nozzle which is activated by reacting to an actuation signal and ejecting a drop, whereby the evaluation device is set up to compare the signals of the photosensor which is assigned to the activated nozzle as well as the signals of the neighboring photosensors with reference signals, and to perform a fault classification on the basis of a deviation from the reference signals. In particular the place-time function S [ti, xi] can be compared with a reference function or reference values. With a correctly functioning nozzle, therefore, the signal will drop sharply as the distance between the photosensors 242 and the photosensor 241 assigned to the nozzle 61 progressively increases. An appropriate function, for example a previously recorded place-time function S [ti, xi], can then be used as a reference function. If for example a unilateral widening appears, or even an additional peak, this may indicate a satellite droplet.

This type of recording can always occur when the pattern to be printed does not activate at least one, preferably at least three nozzles 612 to the left and right of the nozzle 611 to be tested.

A further idea underlying the invention is to transmit the result of the nozzle test back to the raster image processor 81 in order to bring about local changes to the printed image in order to visually cover up the fault.

The wavelength range of the illumination of the light source 23, or its light emitter 231, is preferably selected in such a way that the light reflected by the ejected ink drop (often with the colors CYMK) contrasts clearly with the background. This can for example be achieved by using light in the short-wave range (UV to blue), since through the very small pigment particles contained in the inks the degree of reflection is all the greater the more short-wave the light is (wavelength-dependent backscattering from a fluid with foreign parts). In a further development of the invention it is accordingly provided that the light source should emit light with a wavelength of less than 500 nanometers.

In accordance with another further development of the invention, light from several different narrow-band sources can be used simultaneously in order to optimize various contradictory properties:

a) the improved reflection of short-wave light from ink filled with particles b) the improved penetration of the drop mist in order to record optical properties of the substrate and to discriminate these from the actual drop signal.

In general it is sufficient if the light-conducting property of the print head only exists for a narrow range of the wavelengths in which standard semiconductor photosensors and light emitters work. To achieve this, the light-conducting elements of the print head are preferably transparent in the range of 400 nm to 1000 nm.

Such narrow-band illumination is also advantageous because simple diffractive imaging optics can be produced for narrow-band wavelength ranges.

In accordance with another further development of the invention, the light conductor within the ink fluid of the drop as it forms, as long as the drop is still connected to the nozzle and is not yet detached, is run through a photosensor or light conductor located in the ejecting nozzle and/or in the ink channel of this nozzle to a photosensor and converted into an electrical signal that can be evaluated.

The idea underlying the invention concerns not only ink-jet printers in the actual sense for producing printed products, but also jet-based printing processes that work with so-called functional inks, for example electrically conductive inks for producing printed conductors, biologically active inks for creating so-called bio-chips, synthetic inks for producing 3-dimensional bodies through so-called layer processes etc. All of these processes use print heads with a similar design, with very small dimensions and similar drop ejection mechanisms which can easily fail. The actual difference between these and ink-jet printers for print media is the completely different application in the creation of new products by applying minute quantities of a fluid phase onto a substrate.

While specific embodiments of the invention have been shown and described in detail to illustrate the application of the principles of the invention, it will be understood that the invention may be embodied otherwise without departing from such principles.

The invention claimed is:

1. An ink-jet printer for printing a substrate with graphic and/or functional inks the ink-jet printer comprising:

a print head with ink-jet nozzles;

an optical device at least partially integrated in the print head to monitor the correct functioning of the ink jet nozzles, the optical device illuminating drops ejected from the nozzles by means of light from a light source from a direction of the ink-jet nozzles through the print head by means of illumination signals which are either constant in time or changeable in time, the optical device comprising the light source, light sensitive sensors, a light-conducting element arrangement conducting light from the light source through at least one light-conducting element through the print head and through which light-conducting element arrangement light reflected by the drop ejected from the nozzle during the flight of the drop is conducted backwards in the direction of the nozzles onto the light-sensitive sensors; and an evaluation device to examine the correct form and the correct ejection of the drop, concluded from the specific timing of the sensor signal, wherein:

the print head comprises ink channels which are limited by ribs, with the ribs being component parts of the optical device and being transparent for the light from the light source; and the light source and the light-sensitive sensors are arranged in such a way that the ribs conduct the light from the light source through the print head onto an ejected drop, or conduct the light reflected by an ejected drop through the print head to a photosensor.

2. An ink-jet printer in accordance with claim 1, wherein:

the light-sensitive sensors are photosensors;

the light source and the detectors are arranged in such a way that first ribs conduct light from the light source to the drop ejection side of the print head and second ribs conduct light reflected by the drops through the print head to the photosensors, with the first and second ribs being arranged alternately.

3. An ink jet printer in accordance with claim 1, wherein the print head comprises a nozzle plate in which the nozzles for drop ejection are located, whereby the nozzle plate has windows or cutouts in order to couple out the light from the light source conducted through the print head or to couple in the light reflected from a droplet into the print head.

4. An ink-jet printer in accordance with claim 3, wherein the optical device further comprises beam-shaping, including imaging or focusing, optical elements located on the nozzle plate.

5. An ink-jet printer in accordance with claim 1, wherein:

the light-sensitive sensors are photosensors;

the print head comprises a front side from which ink droplets can be ejected, as well as a rear side located opposite the front side, and whereby the light source is arranged in such a way that light is coupled into the rear side and conducted through the print head to the front side and whereby the photosensors are arranged in such a way that light reflected from ejected drops, entering the front side and being conducted through the print head to the rear side, can be detected by the photosensors.

6. An ink jet printer in accordance with claim 1, wherein the light source comprises several light emitters, whereby each light emitter is assigned a light-conducting element, of the light-conducting element arrangement, into which the light from the light emitter can be coupled and whereby the light emitters are assigned different nozzles, and the light-conducting elements are arranged in such a way that light conducted through the light conductor locally illuminates the area in front of the print head into which drops can be ejected from an assigned nozzle; and an illumination control unit is provided and is set up so that the illumination control unit actuates the light emitters individually when a drop is ejected through an assigned nozzle.

7. An inkjet printer in accordance with claim 6, wherein the evaluation device comprises a raster image processor which is set up to convert the data of a print file into actuation signals for the nozzles of the print head, whereby the print head is set up to eject ink drops out of the nozzles as a reaction to the actuation signals, and whereby the illumination control unit is set up to individually actuate the light emitters assigned to the nozzles for which the actuation signals are intended.

8. An ink-jet printer in accordance with claim 1, wherein the evaluation device is set up to change a print file containing the data of a printed image as a reaction to the ascertainment that at least one of the nozzles of the print head is malfunctioning.

9. An ink-jet printer in accordance with claim 1, wherein the evaluation device is set up to evaluate the signals of neighboring photosensors which are assigned to non-activated nozzles, in addition to the signal of a photosensor which is assigned to a nozzle which is activated by reacting to an actuation signal and ejecting a drop, whereby the evaluation device is set up to compare the signals of the photosensor which is assigned to the activated nozzle as well as the signals of the neighboring photosensors with reference signals and to perform a fault classification on the basis of a deviation from the reference signals.

10. An ink-jet printer, for printing a substrate with graphic and/or functional inks the ink-jet printer comprising:

a print head with ink-jet nozzles;

an optical device at least partially integrated in the print head to monitor the correct functioning of the ink-jet nozzles, the optical device illuminating drops ejected from the nozzles by means of light from a light source from a direction of the ink-jet nozzles through the print head by means of illumination signals which are either constant in time or changeable in time, the optical device comprising the light source, light sensitive sensors, a light-conducting element arrangement conducting light from the light source through at least one light-conducting element through the print head and through which light-conducting element arrangement light reflected by the drop ejected from the nozzle during the flight of the drop is conducted backwards in the direction of the nozzles onto the light-sensitive sensors; and an evaluation device to examine the correct form and the correct ejection of the drop, concluded from the specific timing of the sensor signal, wherein the print head comprises a piezoceramic print head comprising light-conducting ceramic material comprising at least one light conducting element of the light-conducting element arrangement, whereby the light source and the light-sensitive sensors are arranged in such a way that a conduction of light from the light source or from the conduction back of the light reflected by the drops ejected by the nozzles is effected through the light-conducting ceramic material.

11. An ink-jet printer for printing a substrate with graphic and/or functional inks the ink-jet printer comprising:

a print head with ink-jet nozzles;

an optical device at least partially integrated in the print head to monitor the correct functioning of the ink-jet nozzles, the optical device comprising:

a light source illuminating drops ejected from the nozzles from a direction of the ink jet nozzles through the print head, the light source providing illumination based on illumination signals which are either constant in time or change over time;

photosensors; and light-conducting paths, at least one of the light conducting paths conducting light from the light source through the print head and through one or more of the light-conducting paths conducting light reflected by a drop ejected from the nozzle during a travel path of the drop in the direction of the nozzles onto the photosensors; and an evaluation device connected to the photosensors to evaluate the form and the ejection of the drop based on signals from the photosensors, wherein:

the print head comprises ink channels which are limited by ribs, with the ribs being component parts of the optical device and being transparent for the light from the light source; and the light source and the photosensors are arranged in such a way that the ribs conduct the light from the light source through the print head onto an ejected drop, or conduct the light reflected by an ejected drop through the print head to a photosensor.

12. An ink-jet printer in accordance with claim 11, wherein the print head comprises a nozzle plate in which the nozzles for drop ejection, whereby the nozzle plate has windows or cutouts in order to couple out the light from the light source conducted through the print head or to couple in the light reflected from a droplet into the print head.

13. An ink jet printer in accordance with claim 11, wherein:

the print head comprises a front side from which ink droplets can be ejected, as well as a rear side located opposite the front side;

the light source is arranged such that light is coupled at the rear side and conducted through the print head to the front side; and the photosensors are arranged in such a way that light reflected from ejected drops, entering the front side and conducted through the print head to the rear side, is detected by the photosensors.

14. An ink jet printer in accordance with claim 11, further comprising an illumination control unit wherein:

the light-conducting paths are defined by a plurality of light-conducting elements;

the light source comprises a plurality of light emitters, whereby each light emitter is assigned to a corresponding one of the light-conducting elements;

each of the light-conducting elements, with a light source assigned thereto, is assigned to one of different nozzles, and the light-conducting elements, with a light source assigned thereto, are arranged in such a way that light conducted therethrough locally illuminates the area in front of the print head into which drops can be ejected from an assigned nozzle; and the illumination control unit actuates the light emitters individually when a drop is ejected through an assigned nozzle.

* * * * *